US012247377B2

(12) United States Patent
Lacher et al.

(10) Patent No.: US 12,247,377 B2
(45) Date of Patent: Mar. 11, 2025

(54) AERATOR

(71) Applicant: Neoperl GmbH, Mullheim (DE)

(72) Inventors: Wolf-Dieter Lacher, Mullheim (DE); Holger Schürle, Mullheim (DE)

(73) Assignee: NEOPERL GMBH, Mullheim (DE)

( * ) Notice: Subject to any disclaimer, the term of this patent is extended or adjusted under 35 U.S.C. 154(b) by 465 days.

(21) Appl. No.: 17/435,772

(22) PCT Filed: Mar. 5, 2020

(86) PCT No.: PCT/EP2020/055925
§ 371 (c)(1),
(2) Date: Sep. 2, 2021

(87) PCT Pub. No.: WO2020/182629
PCT Pub. Date: Sep. 17, 2020

(65) Prior Publication Data

US 2022/0154438 A1 May 19, 2022

(30) Foreign Application Priority Data

Mar. 8, 2019 (DE) ..... 202019101313.3

(51) Int. Cl.
*E03C 1/084* (2006.01)

(52) U.S. Cl.
CPC ..... *E03C 1/084* (2013.01)

(58) Field of Classification Search
CPC ..... E03C 1/08; E03C 1/084; E03C 1/086
USPC ..... 239/428.5
See application file for complete search history.

(56) References Cited

U.S. PATENT DOCUMENTS

| | | | | |
|---|---|---|---|---|
| 4,000,857 | A * | 1/1977 | Moen | B05B 1/3006 239/572 |
| 6,029,912 | A * | 2/2000 | Woolley | B05B 1/26 239/543 |
| 6,695,011 | B2 * | 2/2004 | Sochtig | G05D 7/012 138/46 |
| 8,342,431 | B2 * | 1/2013 | Stein | E03C 1/086 285/8 |
| 2017/0218609 | A1 * | 8/2017 | Lin | G05D 7/012 |

FOREIGN PATENT DOCUMENTS

| | | |
|---|---|---|
| CN | 102912831 | 2/2013 |
| CN | 106703131 | 5/2017 |
| CN | 107191671 | 9/2017 |
| DE | 102011120007 | 9/2012 |
| GB | 1038638 | 8/1966 |
| GB | 2309181 | 7/1997 |
| WO | 2012025047 | 3/2012 |

* cited by examiner

*Primary Examiner* — Jason J Boeckmann
(74) *Attorney, Agent, or Firm* — Volpe Koenig

(57) ABSTRACT

An aerator (1) having a housing (2) and a jet-splitting device (3) arranged or formed in the housing (2) for splitting an individual jet into a plurality of separate liquid components. The aerator (1) has at least two flow channels (4), which are oriented obliquely in such a way that the outlet directions (12) defined by the flow channels (4) meet each other. An insert part (5) is inserted into a hole (6) in the main body (28) of the jet-splitting device (3), which hole is oriented in particular in the longitudinal direction of the housing (2), such that the hole (6) is divided into the at least two obliquely extending flow channels.

19 Claims, 8 Drawing Sheets

AERATOR

TECHNICAL FIELD

The invention relates to an aerator with a housing, a jet-splitting device, arranged or formed in the housing, for the purpose of splitting an individual stream into a plurality of separate liquid portions, wherein the jet-splitting device has at least two flow channels which are oriented obliquely such that the streams formed by the flow channels meet each other.

BACKGROUND

Aerators of this type having obliquely extending flow channels are already known. However, the production of such aerators which are produced at least partially by injection molding is relatively complex. This is especially due to the fact that the two obliquely extending flow channels must be produced by two injection-molding tool cores which need to be removed from the mold in different directions. The production of previously known aerators is thus relatively complex and expensive.

SUMMARY

The object thus consists in providing an aerator of the type mentioned at the beginning and a method for its production, in which the disadvantages mentioned are overcome.

The solution of this object is achieved according to the invention by an aerator having one or more of the features disclosed herein. An aerator of the type mentioned at the beginning is in particular proposed according to the invention for achieving the object, wherein an insert part is inserted into a hole of a base body of the jet-splitting device such that the hole is divided into the at least two obliquely extending flow channels. It is thus possible, by virtue of the at least two-part design of the flow channels, to orient its outlet angle obliquely more simply than in previously known methods. The hole in the base body can be produced by means of an injection-molding core which needs to be removed from the mold in one direction, preferably a direction extending perpendicular to the surface of the base body. The separately produced insert part can then be inserted into the hole, as a result of which the hole is divided into the at least two flow channels. Considerably simpler production of the obliquely extending flow channels is thus possible. The flow channels can, for example, be oriented obliquely with respect to a longitudinal axis of the housing and/or a main direction of flow.

Advantageous embodiments of the invention are described below which can optionally be combined together with the features noted above individually or in combination with the features of other embodiments.

Alternatively or additionally, it can be provided that the said intersection point lies in the associated hole or in its extension, i.e. for example below the hole. Outflow parallel to or along a housing axis can thus be achieved.

According to a particularly advantageous development, it can be provided that the water streams that flow out from the flow channels meet at an intersection point, in particular wherein the intersection point lies inside or outside the base body and/or in the associated hole or in its extension. According to a particularly preferred embodiment, the intersection point can lie inside a chamber, for example a chamber situated downstream from the jet-splitting device. The intersection point can more preferably lie inside an air inlet part and/or inside a mixing part. This has the advantage that less noise is generated during the operation of the aerator than when the intersection point lies inside the jet-splitting device.

It can also be provided that the insert part covers a hole, for example the already mentioned hole, in particular all holes of this type. It is thus ensured in a simple manner that a flow is forced into the two flow channels. A main flow through one of the two flow channels, at the expense of the other, can thus be avoided.

According to a further advantageous embodiment of the aerator, a flow channel or both flow channels can be configured as a nozzle with a cross-sectional surface area which reduces in the main direction of flow and/or along the course of the duct. It is thus possible that a reduced pressure can be generated on the outflow side of the nozzle or is generated when the aerator is being used. The stream can moreover be accelerated by the nozzle. This can be used, for example, to accelerate the stream before it strikes a deflector surface in order to be able to achieve the best possible mixing of the liquid portions with air. The reduced pressure generated can be used, for example, to draw air in from outside. The embodiment as an atomizer nozzle by means of which a spray mist can be generated is particularly advantageous. Improved admixing of air to the liquid portions is possible as a result. This means that the reduced pressure prevailing on the outflow side of the nozzle can be compensated constantly.

Alternatively or additionally, one flow channel or both flow channels can each be formed as a diffusor with a cross-sectional surface area which widens in the main direction of flow and/or along the course of the duct. It is thus possible for the stream to be slowed down by the flow channel configured as a diffusor.

In order to be able to generate an aerated stream by means of the aerator, a stream-aerating device for mixing the liquid portions with air can be arranged downstream from the jet-splitting device in the main direction of flow. The stream-aerating device can have at least one aerating orifice via which, owing to the above-described reduced pressure generated by the jet-splitting device inside a chamber of the stream-aerating device, air can be drawn into the chamber from outside. The drawn-in air can be mixed with liquid portions inside the chamber, as a result of which an aerated stream is generated.

According to a further advantageous embodiment of the aerator, the insert part can be inserted into a circular groove, and/or one formed on the inflow side, in the base body. It is consequently easier to prevent relative movement of the insert part with respect to the base body from occurring. Owing to the pressure prevailing on the inflow side of the insert part during the inflow of water, said insert part is pressed into the groove. It is thus possible to produce the flow channels in a particularly simple fashion, wherein, by virtue of the insert part being inserted into the groove, the insert part is arranged inside the hole at a defined distance from the base body.

A particularly advantageous embodiment of the aerator can provide that the insert part has an annular design. A symmetrical spray pattern can thus be generated. Alternatively, the insert part can also be designed as a plug. A compact insert part can thus be provided.

Alternatively or additionally, it can be provided that the insert part has a shape that tapers in the direction of flow. It is thus simpler to insert the insert part into the hole and/or into the groove when assembling the aerator. It can thus be achieved that the insert part has a convex, in particular V-shaped contour in an axial section.

The outlet angle of the two flow channels can be defined by at least one wall, forming the hole, of the base body and an outer contour of the insert part. The side walls of the flow channels are therefore formed at least partially by the base body and at least partially by the insert part.

In order to be able to better prevent the insert part from slipping out of the hole and/or the groove, according to an advantageous embodiment of the aerator it can be provided that the insert part is fixed on the base body by a retaining device. The retaining device can be formed, for example, as at least one latching projection formed on an inflow-side upper side of the base body. This has the advantage that the insert part is better retained on the base body, even when there is, for example, high water pressure. The insert part can be inserted into the hole and/or the groove during assembly, counter to resistance generated by the retaining device, by applying an assembly pretensioning force. In the assembled position, the insert part is acted upon at least partially by the retaining device. In particular, the insert part is acted upon by the retaining device on an upper side facing away from a groove base of the groove.

According to an advantageous embodiment, the hole can be oriented perpendicular to the insert part in the base body. In particular, the hole can be oriented perpendicular to a circumferential direction of the insert part. The hole can, for example, take the form of a slot and/or be oriented in the radial direction. A symmetrical stream can thus be generated by the flow channels.

The aerator can, for example, have a plurality of pairs or groups of flow channels, wherein the at least two flow channels of a pair or a group are oriented obliquely in such a way that the streams formed by the flow channels meet each other. The pairs or groups of flow channels can, for example, be formed in a circle one after the other and/or with the same spacing from each other.

In order to be able to obtain a particularly good mixing of liquid and air, the liquid flowing through the at least two flow channels can subsequently strike a deflector body of a stream-aerating device, for example the already abovementioned stream-aerating device. The deflector body can preferably have a conical shape and/or taper in the opposite direction to the main direction of flow. It can be particularly expedient if a plurality of homogenizing elements are arranged on a deflector surface formed by the deflector body.

In order to be able to prevent leakage caused by the outlet of spraying water from an aerating orifice of the stream-aerating device, the aerator can have a perforated restrictor which is arranged inside a chamber of the stream-aerating device and divides the chamber into an air inlet part and a mixing part, wherein the mixing part and the air inlet part are connected to each other via a restrictor orifice of the perforated restrictor. The outlet of liquid from the stream-aerating devices can be better prevented by virtue of the perforated restrictor by splashing water being contained in the mixing part.

According to a particularly preferred embodiment, it can be provided that an inflow orifice and an outflow orifice of at least one flow channel do not overlap each other along the longitudinal axis. Turbulence inside the flow channel can thus be better prevented, which has the consequence of generating less noise.

According to a further advantageous embodiment, at least one flow channel or all the flow channels can have a stepless design. In other words, this can mean that no walls extending along or parallel to the longitudinal axis of the aerator and delimiting the flow channels are thus provided. In the case of previously known aerators with obliquely extending flow channels of this type, the latter have steps as part of the production process in order to enable removal of an injection-molding tool from the mold during manufacture. By virtue of the embodiment according to the invention of the flow channels, it is possible by means of an insert part inserted into a hole for the flow channels to have a stepless design. This has the advantage that turbulence can be better prevented in order to minimize the noise level when the aerator is in operation. A further advantage consists in the fact that the flow channels can be placed at a steeper angle with respect to a longitudinal axis of the aerator. A stream can thus be set at a sufficiently steep angle and a second stream not set obliquely and which can flow in a longitudinal direction through the flow channel is prevented from colliding with the deflected stream.

According to an advantageous development, the insert part can have at least two insert bodies which are inserted in each case into a hole of the base body such that each hole through the insert body is divided in each case into at least two obliquely extending flow channels. A greater flow per unit time is thus enabled.

According to a particularly advantageous embodiment, it can be provided that the at least two insert bodies are connected to each other via a plurality of retaining webs. In particular, the retaining webs can be oriented in a radial direction and/or be arranged in a circle at regular distances from one another.

According to a further advantageous embodiment, it can be provided that the base body has an assembly cone and that the insert part has a recess provided for the introduction of the assembly cone, the inner wall of said recess being adapted to the shape of the assembly cone. The assembly cone and the inner wall can preferably each have an octagonal cross-section. The assembly cone and the recess cannot be coupled together randomly such that a relative orientation of the two parts with respect to each other is predetermined by their shapes. The assembly of the aerator can thus be simplified.

The object of the invention is moreover achieved by a method for producing a base body and/or an aerator with a jet-splitting device, having a base body, with the features of the independent method claim, wherein the base body has at least two flow channels which are oriented obliquely, and wherein the two outlet directions of the at least two flow channels meet each other. It is here in particular proposed for the production of an aerator, in particular as described and claimed herein, that the base body is produced in an injection-molding method, and that an insert part is inserted into a hole of the base body such that the hole is divided by the insert part into the at least two flow channels.

The flow channels can here be oriented obliquely relative to a longitudinal axis of the housing and/or relative to a main direction of flow and/or relative to a normal vector which stands on an upper surface of the base body.

This has the advantage that there is no need for two injection-molding cores which need to be removed from the mold in different directions in order to produce the base body. The production of the base body and/or the aerator is thus considerably simpler compared with previous production methods for generic aerators.

BRIEF DESCRIPTION OF THE DRAWINGS

The invention is now described in detail with the aid of a plurality of exemplary embodiments but is not limited to these exemplary embodiments. Further exemplary embodiments arise from the combination of the features of one or more claims with one another and/or with one or more features of the exemplary embodiments.

In the drawings.

DETAILED DESCRIPTION

Figure 1:
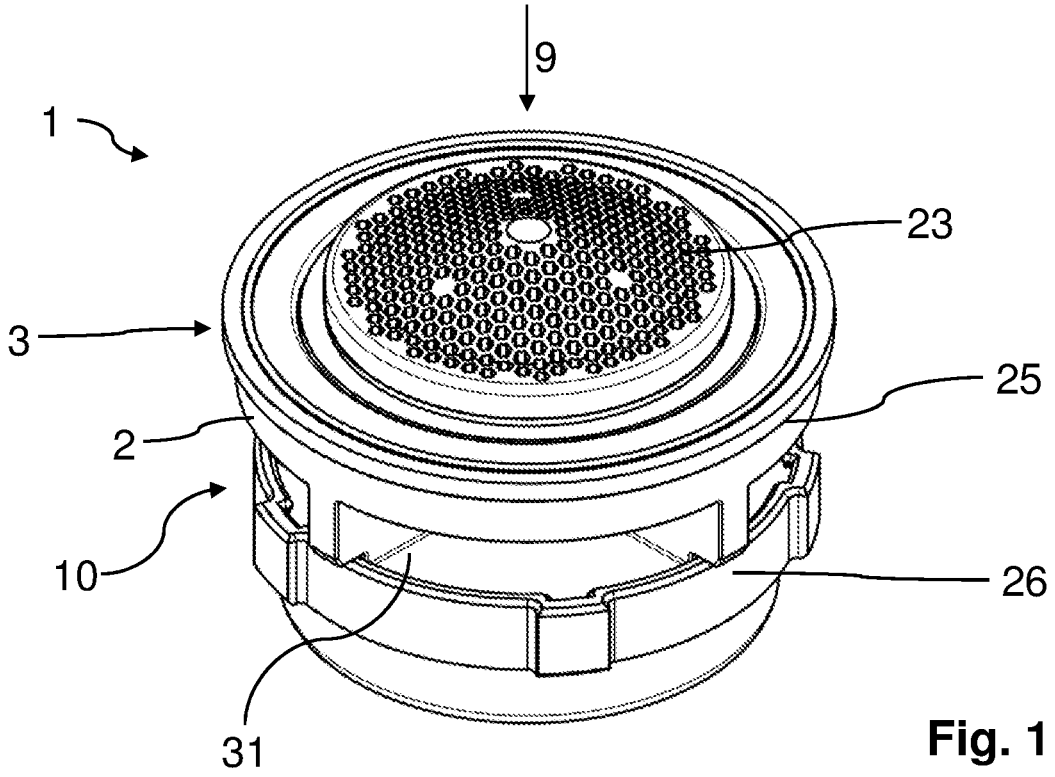
FIG. 1 shows a perspective view of an alternative embodiment of an aerator according to the invention.

An aerator designated in each case as a whole by 1 is shown in FIGS. 1-16. The aerator 1 can be configured to be inserted into a sanitary outlet fitting.

The aerator 1 has a housing 2. The housing 2 can, for example, have a coupling point which can be coupled to a corresponding mating coupling point of an aerator socket on the outlet fitting. The housing 2 can have a multi-part design. The housing 2 can, for example, have an upper housing part 25 and a lower housing part 26.

The aerator 1 furthermore has a jet-splitting device 2 which is configured to split an individual stream into a plurality of separate liquid portions.

The jet-splitting device 3 has at least one pair of two flow channels 4 or a group of in each case more than two flow channels 4 which are oriented obliquely, in particular obliquely relative to a longitudinal axis 34 of the aerator 1, in such a way that the streams formed by the flow channels 4 meet each other. In the embodiment shown, the flow channels 4 run toward each other. The outlet directions of the flow channels 4 therefore intersect. The jet-splitting device 3 can at least partially be formed by the upper housing part 25.

In order to produce the at least one pair or the group of flow channels 4, an insert part 5 is inserted into a hole 6 of a base body 28 of the jet-splitting device 3. The hole 6 is divided into the two flow channels 4 of the pair or the group by the insert part 5. The base body 28 can be configured, for example, as a perforated plate.

It is thus possible to do without the need for a plurality of injection-molding cores to form the flow channels 4 when producing the aerator 1 and/or the base body 28 in an injection-molding method. This has the advantage that there is no need to remove the injection-molding cores from the mold in different directions, in particular in the respective direction in which the flow channels 4 extend. The hole 6 can, for example, be produced in the base body 28 in an injection-molding method. This can therefore be performed with just one injection-molding core. Removal from the mold in just one direction is thus possible, which considerably simplifies the production process of the aerator and makes it much more cost-effective.

Figure 3:
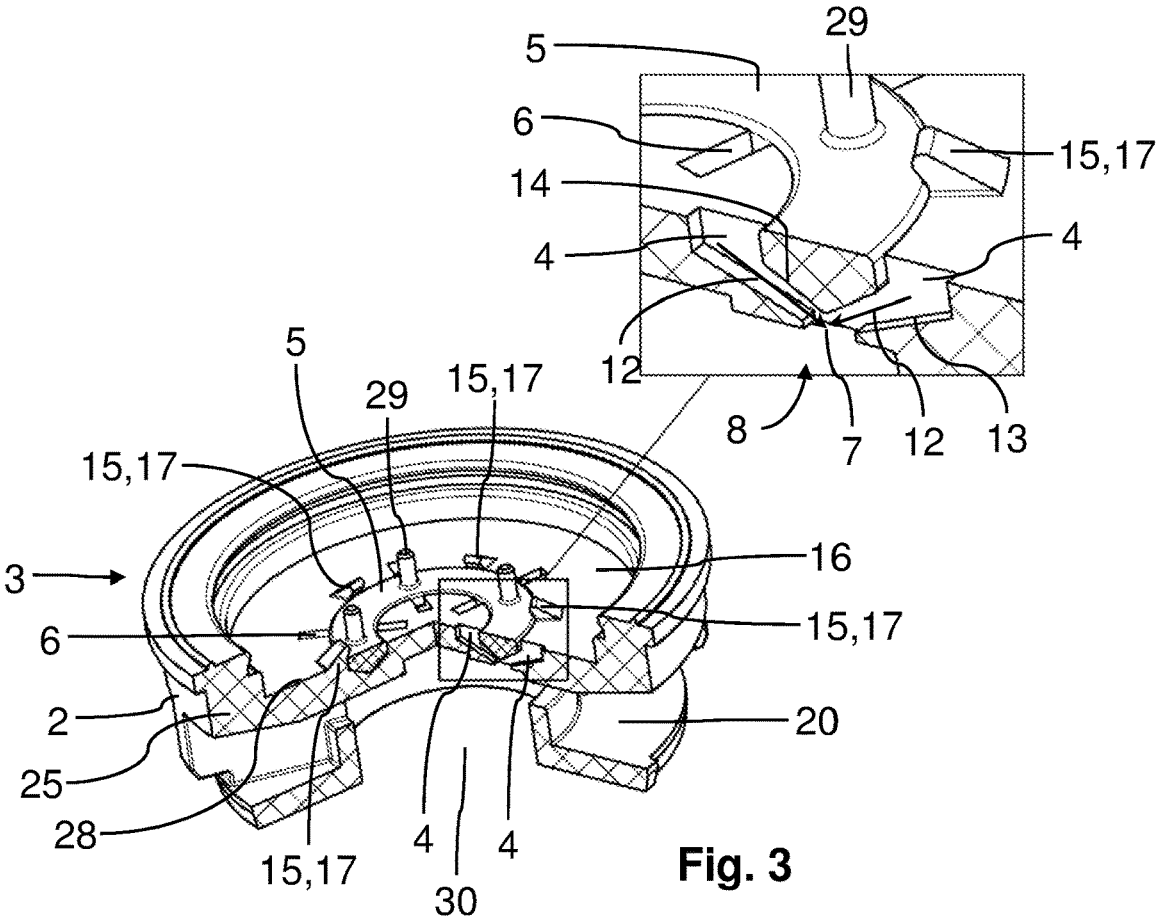
FIG. 3 shows a partially cutaway view of a jet-splitting device, wherein the insert part is inserted into the base body, wherein a detailed view of the highlighted region is shown in the box, in which the hole divided into the flow channels by the insert part is shown.
Figure 4:
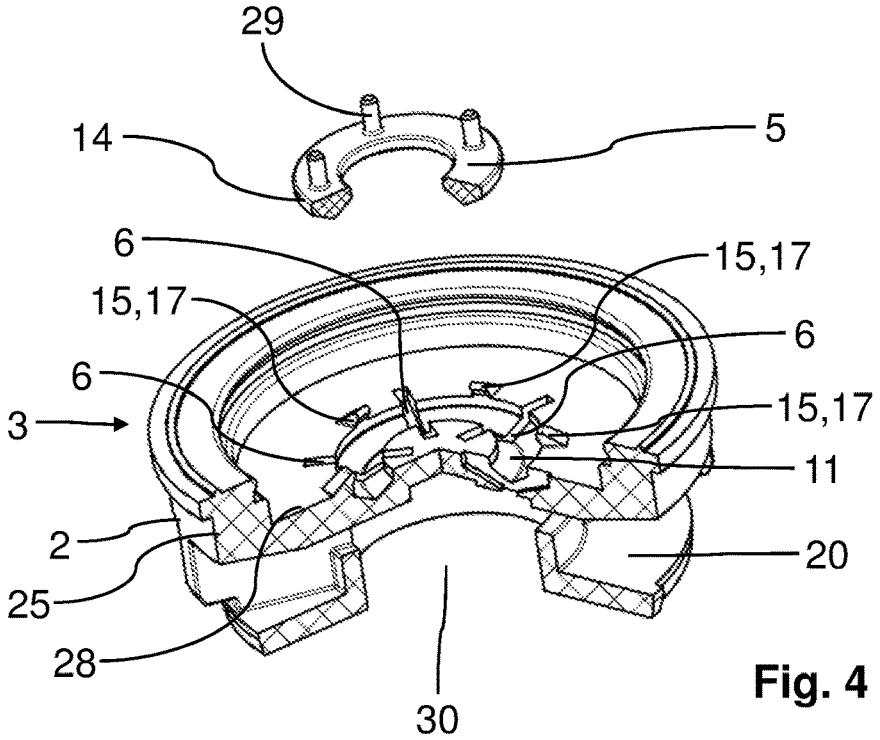
FIG. 4 shows a partially cutaway view of a jet-splitting device, the insert part having been removed from the base body.
Figure 5:
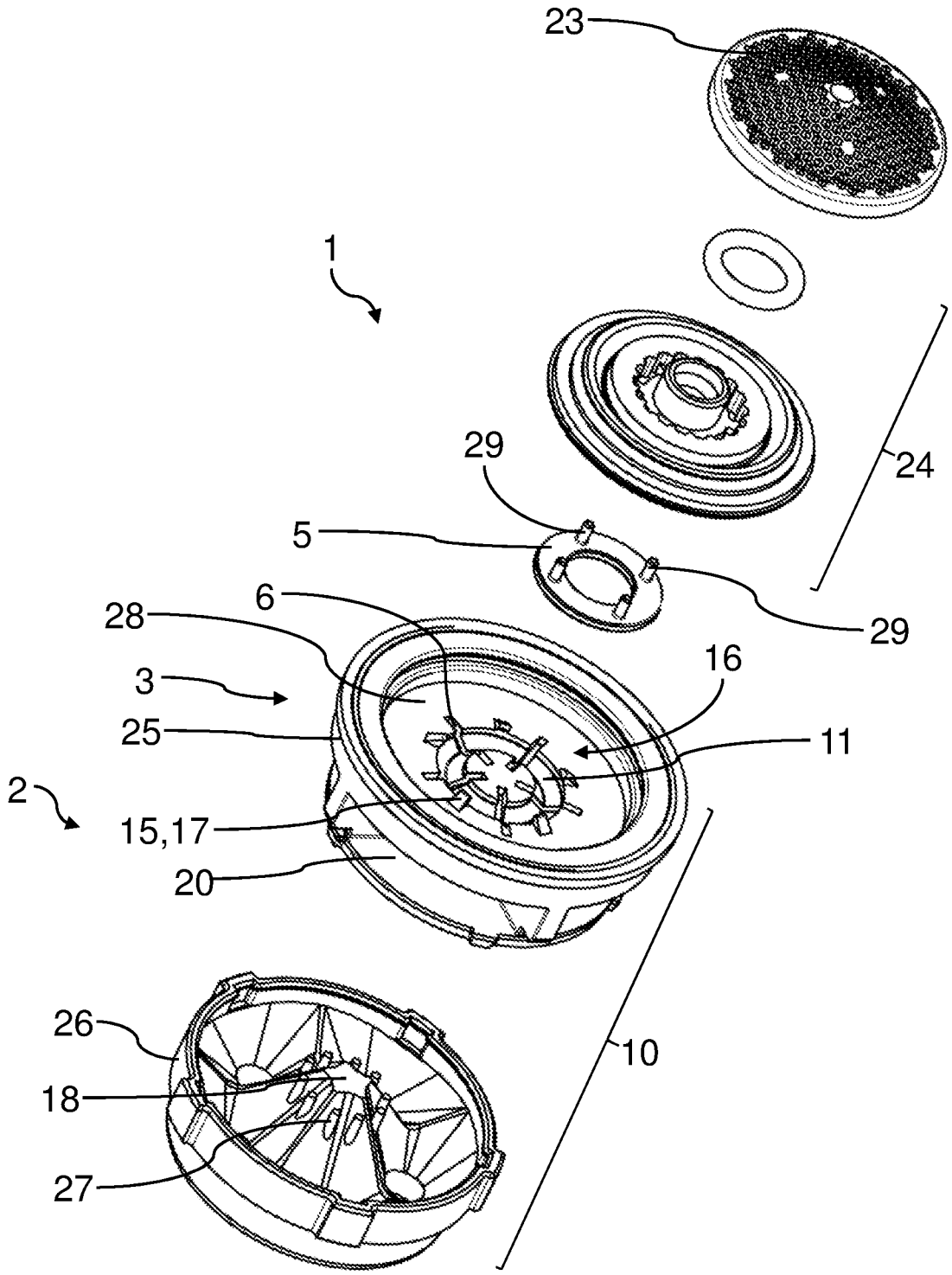
FIG. 5 shows an exploded view of the alternative embodiment of the aerator from FIGS. 1-4.

As shown in FIGS. 3-5, the aerator 1 can have a plurality of pairs or groups of flow channels 4. The pairs or groups of flow channels 4 can, for example, in each case be formed the same distance apart from one another and/or lying in a circle. A particularly symmetrical spray pattern and/or particularly good splitting of the individual stream into separate liquid portions can thus be generated.

The liquid flowing out of the at least two flow channels 4 of a pair or a group in each case forms a stream of liquid at an outlet orifice of each flow channel 4. The two streams of liquid exiting the flow channels 4 of a pair or group meet each other at an intersection point 7. The intersection point 7 can here lie inside or outside the base body 28. Different stream properties can thus be generated.

The exiting partial stream can have a uniform cross-section behind the intersection point 7.

The flow channels 4 shown in FIGS. 2-5 are each configured as a nozzle 8. A cross-sectional surface area of the respective flow channel 4 therefore reduces along the course of the flow channel 4 and/or in the main direction of flow 9. The nozzle 8 can be used to accelerate the stream. The nozzle 8 can preferably be configured as an atomizer nozzle in particular for producing a spray mist, which, by virtue of the atomization of the liquid portions, causes an improved aeration of the stream owing to the generation of a reduced pressure and the drawing in of air.

According to a further alternative embodiment not shown in the drawings, the flow channels 4 can also each be configured as a diffusor. A cross-sectional surface area of the respective flow channel 4 thus widens along the course of the flow channel 4 and/or in the main direction of flow 9. The diffusor can be used to slow down the stream.

A flow rate regulator 24 can be connected upstream from the jet-splitting device 3 in the main direction of flow 9. It can thus be achieved that a defined volume flow at all times flows into the jet-splitting device 3 and an outlet spray pattern is generated which is as uniform as possible.

A stream-aerating device 10 can be mounted downstream from the jet-splitting device 3 in the main direction of flow 9. Air can be drawn in by the stream-aerating device 10 via an aerating orifice, wherein the drawn-in air is mixed with the liquid portions in a chamber 19. A reduced pressure can be generated inside the above-described chamber 19 by the above-described nozzle 8, as a result of which surrounding air can be drawn in from outside via an aerating orifice 31.

The at least one abovementioned intersection point 7 of the streams of liquid exiting the flow channels 4 of a pair or a group thereof lies inside the chamber 19 in the alternative embodiment shown. This has the advantage that there is a considerably lower amount of noise generated when a liquid is flowing through than in the case of previously known aerators. In the case of previously known aerators, which likewise can be configured such that streams of liquid intersect at an intersection point, this intersection point usually lies inside the base body 28. However, this causes vibration at the jet-splitting device 3 and thus increases the noise level during the operation of the aerator.

The insert part 5 is inserted into a groove 11 and retained therein in the assembled state. The groove 11 can, for example, be annular and/or circular. In the embodiment shown in FIG. 5, the groove 11 is formed on an upper side 16 of the base body 28. A groove base of the groove 11 is here interrupted by the at least one hole 6. The hole 6 can thus also be formed at least partially by the groove 11. The groove 11 is preferably open on the inflow side in the main direction of flow 9 in order to be able to receive the insert part 5. In the inserted state of the insert part 5, the latter can therefore be pressed into the groove 11 by the pressure of the inflowing liquid.

As can be clearly seen in FIGS. 3 and 4, the insert part 5 has a shape which tapers in the main direction of flow 9 and/or in the longitudinal direction of the housing 2. A cross-section of the insert part 5 can in particular have a tapering shape in the main direction of flow 9 and/or in the longitudinal direction of the housing 2.

The insert part 5 of the embodiment shown in FIGS. 1-5 is configured in the form of a ring.

A plurality of adjusting aids 29 arranged spaced apart from one another are formed on an upper side of the insert part 5. The adjusting aids 29 can, for example, each be formed as a pin protruding in particular in the axial direction. The adjusting aids 29 can serve to more simply achieve correct orientation of components arranged on the inflow side with respect to the jet-splitting device 3. An inflow orifice mounted upstream from the jet-splitting device 3 can, for example, here be arranged flush with the flow channels 4.

An outlet angle 12 of a flow channel 4 can be defined both by the base body 28 and the insert part 5. A wall 13 of the hole 6 and an outer contour of the insert part 5 can, for example, form a duct wall defining the course of the flow channel 4.

A retaining device 15 can be arranged or integrally formed on the base body 28. The retaining device 15 can, for example, be configured on an upper side 16 of the base body 28. In the embodiments of the retaining device 15 shown in the drawings, it has a plurality of latching projections 17, arranged on the edge of the groove 11 and the free ends of which are arranged at least partially above the groove 11. To assemble it, the insert part 5 is inserted into the groove 11 counter to a pretensioning force formed by the latching projections 17. In the assembled position, an upper side of the insert part 5 is acted upon by the latching projections 17 and is thus retained in the groove 11. It is thus possible to prevent the clear opening of the flow channels 4 from being modified by a relative movement of the insert part 5 with respect to the base body 28, in particular during the use of the aerator 1.

The hole 6 in the base body 28 which is divided into the at least two flow channels 4 in the assembled position has, for example, a slot shape. A clear opening of the hole 6 on the upper side 16 of the base body 28 is here configured to be greater than a clear opening on the underside of the base body.

The slot-shaped hole 6 is configured transversely or perpendicular to a circumferential direction and/or a longitudinal axis of the insert part 5. The orifices of the at least two flow channels 4 on the upper side 16 of the base body 28 are thus separated from each other by the insert part 5. In particular, one orifice of a flow channel 4 can adjoin an inner circumference of the insert part 5, and one orifice of a flow channel 4 can adjoin an outer circumference of the insert part 5.

Figure 2:
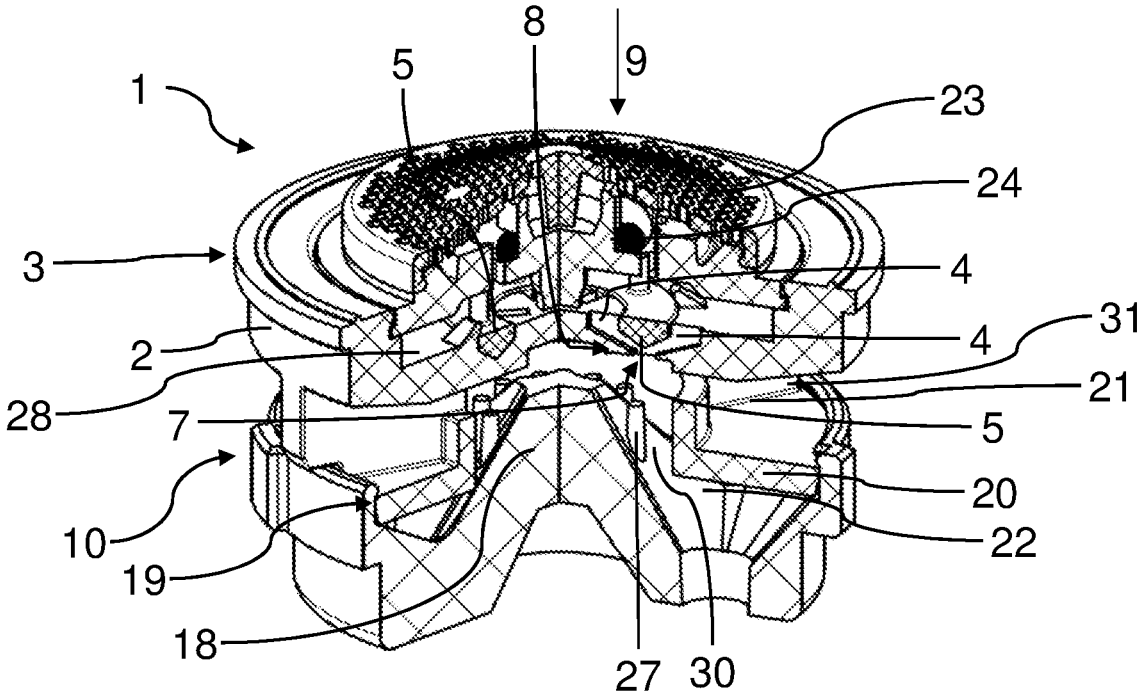
FIG. 2 shows a partially cutaway view of the alternative embodiment of the aerator from FIG. 1.
Figure 6:
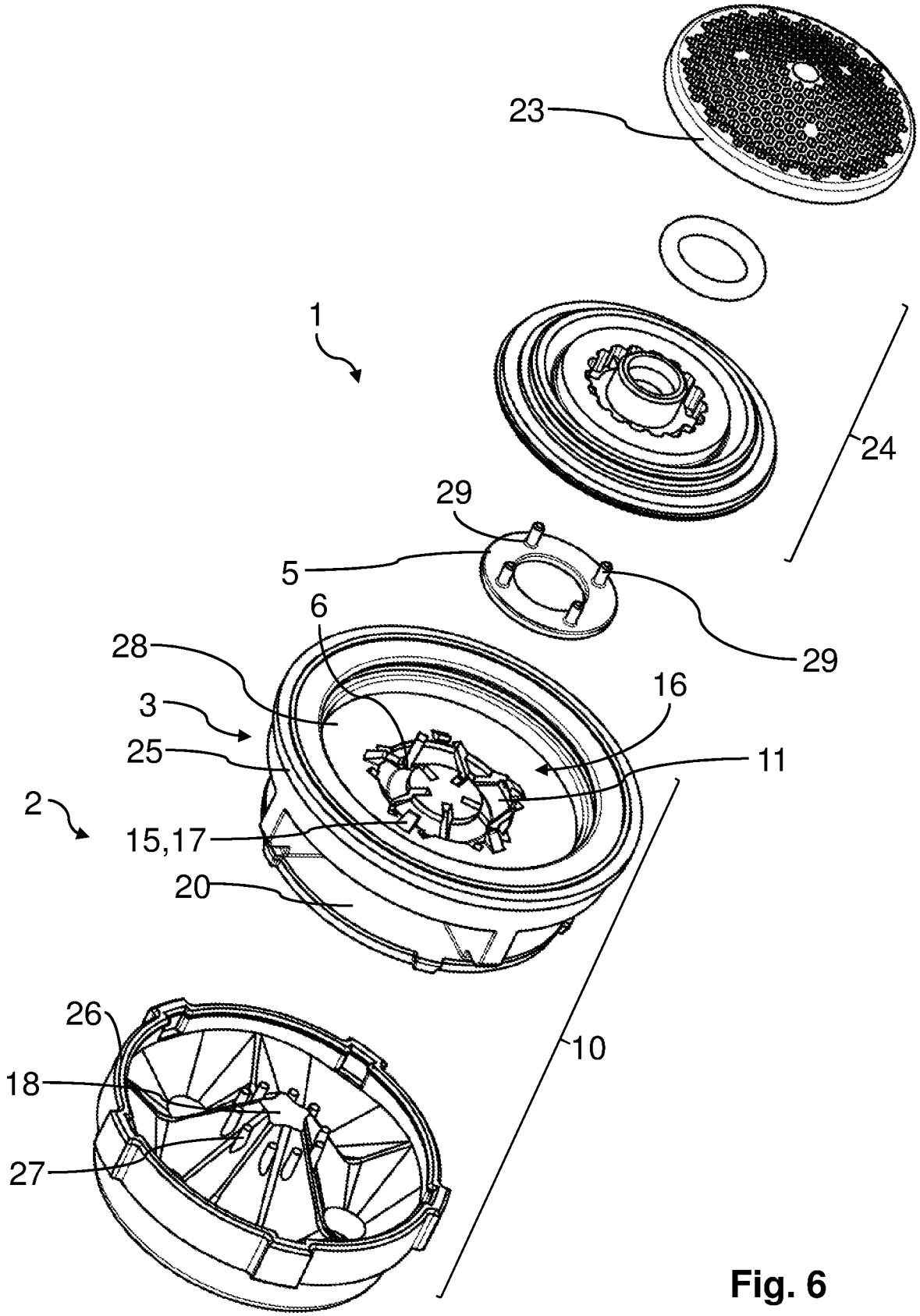
FIG. 6 shows a further aerator according to the invention in an exploded view.

As can be seen in FIGS. 2 and 6, a deflector body 18 can be arranged on the outflow side of the jet-splitting device 3. The deflector body 18 can be formed, for example, by the lower housing part 26. The deflector body 18 can taper in the opposite direction to the main direction of flow 9 and/or upward. As can be seen in FIGS. 2 and 6, the deflector body 18 can thus have a conical shape. Particularly good mixing of air and liquid can be achieved by the deflector body 18.

The deflector body 18 has a deflector surface which is struck inside the stream-aerating device 10 by the liquid portions split by the jet-splitting device 3. A plurality of homogenizing elements 27 are arranged or integrally formed on the deflector surface. The homogenizing elements 27 can have, for example, the shape of a pin and/or rod. In particular, the homogenizing elements 27 can be oriented transversely with respect to the deflector surface and/or in the longitudinal direction of the housing 2. Even better mixing of liquid and air and straightening of the liquid portions is possible owing to the homogenizing elements 27. A particularly attractive outlet spray pattern can thus be generated.

In order to be able to better avoid the escape of spray water via the aerating orifices 31 of the stream-aerating device 10, a perforated restrictor 20 is arranged in the chamber 19 and divides the latter into an air inlet part 21 and a mixing part 22. The air inlet part 21 and the mixing part 22 are connected to each other via a restrictor orifice 30 of the perforated restrictor 20.

The base body 28 is covered on the inflow side, at least in the region of the flow channels 4, by a screen.

Figure 7:
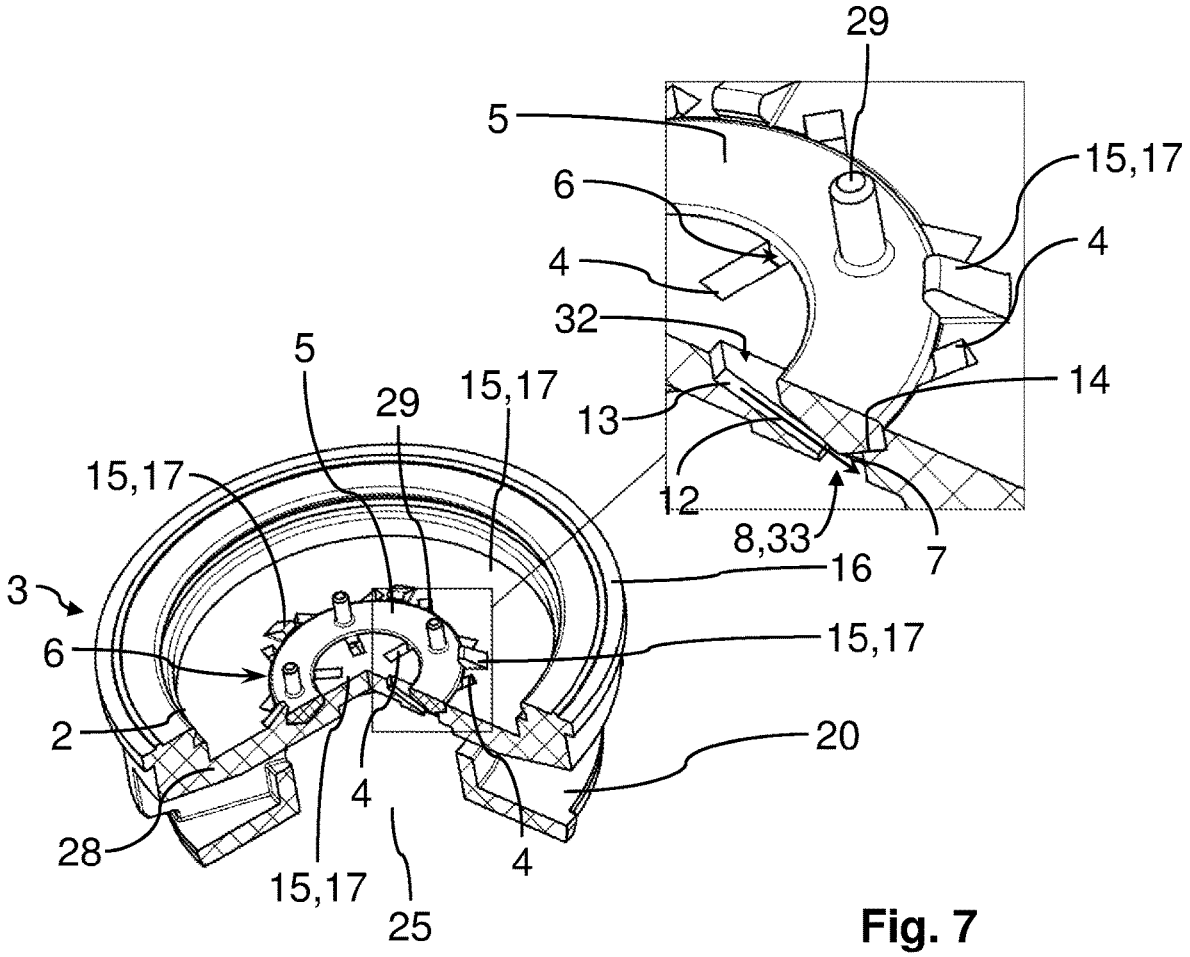
FIG. 7 shows the aerator from FIG. 6 in a partially cutaway view (on the left) and in a detailed enlarged view (top right)
Figure 8:
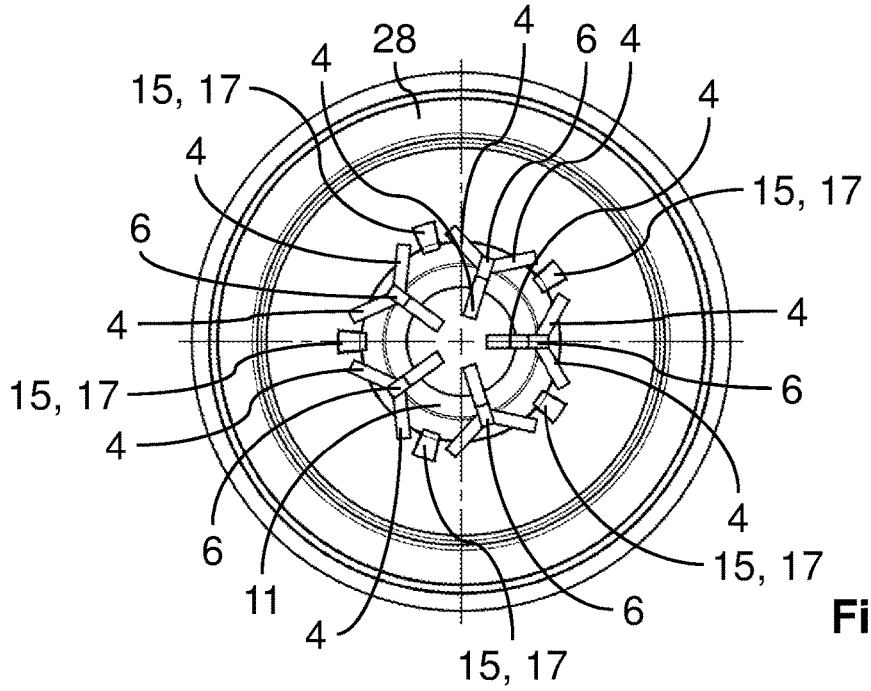
FIG. 8 shows an aerator from FIG. 7 in a view from above of the inflow side, the insert part having been removed.

FIGS. 6 to 8 show a further exemplary embodiment according to the invention. Components and functional units that are functionally or structurally identical or similar to the preceding exemplary embodiment are designated with the same reference numerals and are not described separately. The embodiments in FIGS. 1 to 5 therefore apply to those in FIGS. 6 to 8.

The exemplary embodiment according to FIGS. 6 to 8 differs from the preceding exemplary embodiment at least in that more than two flow channels 4, in this case three flow channels 4, which extend toward the hole 6 in a star shape are associated with each hole 6.

Figure 9:
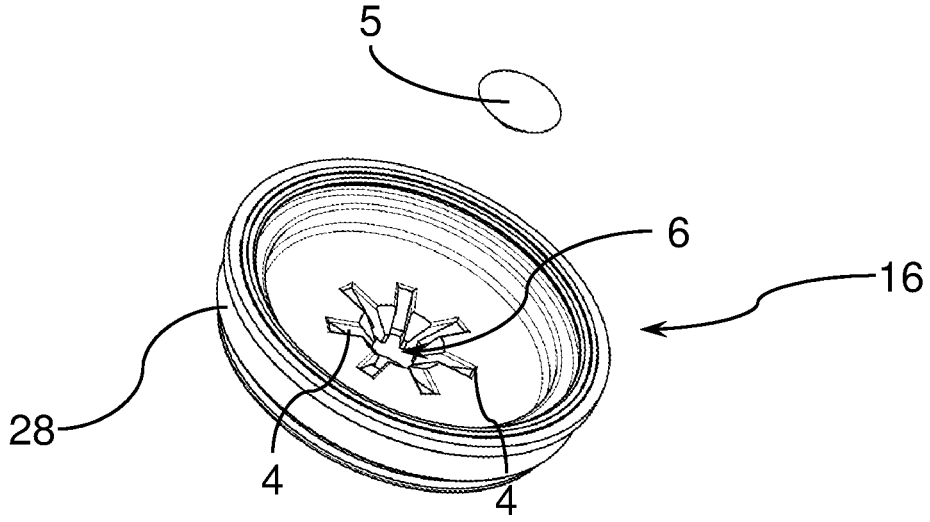
FIG. 9 shows part of a further aerator according to the invention in a three-dimensional oblique view of the inflow side.
Figure 10:
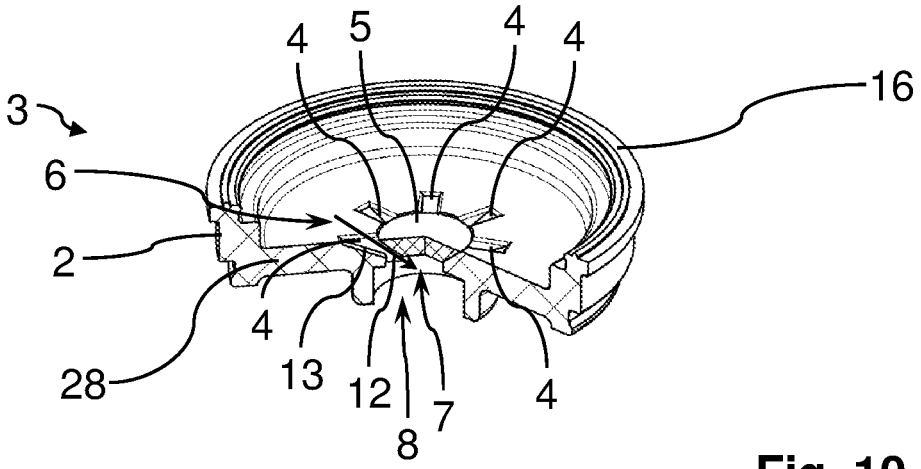
FIG. 10 shows the aerator from FIG. 9 in a partially cutaway view.
Figure 11:
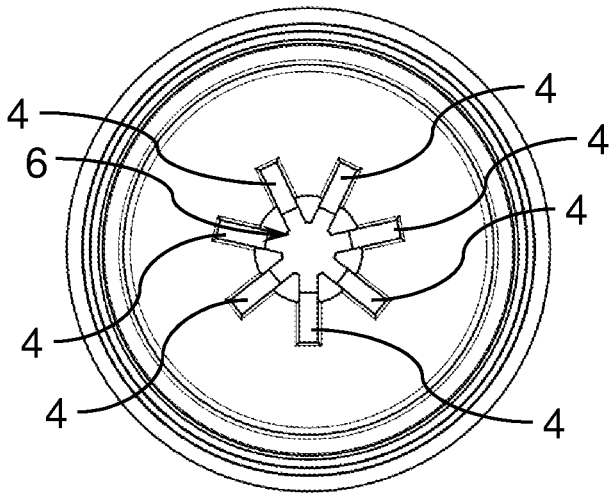
FIG. 11 shows the aerator from FIG. 9 in a view of the inflow side.
Figure 12:
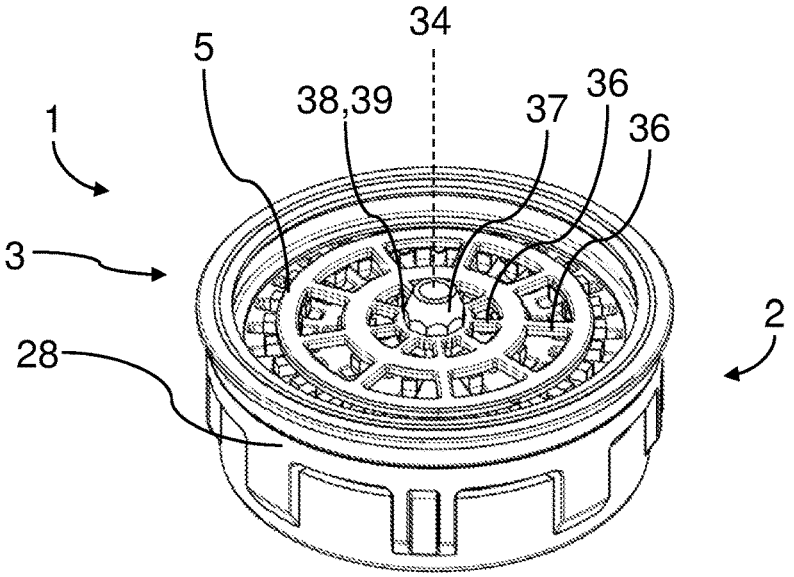
FIG. 12 shows a perspective view of a further alternative embodiment of an aerator according to the invention, wherein the insert part has two insert bodies which are connected to each other via retaining webs.
Figure 13:
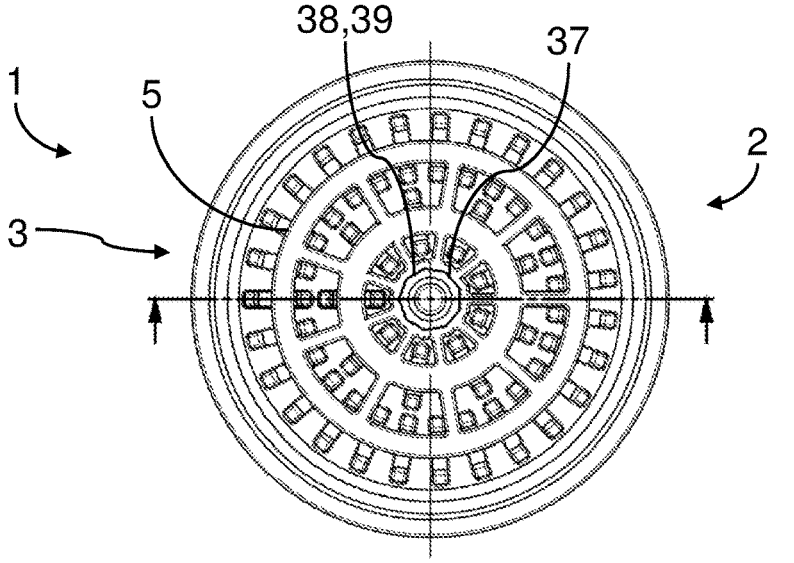
FIG. 13 shows a plan view of the aerator from FIG. 12.
Figure 14:
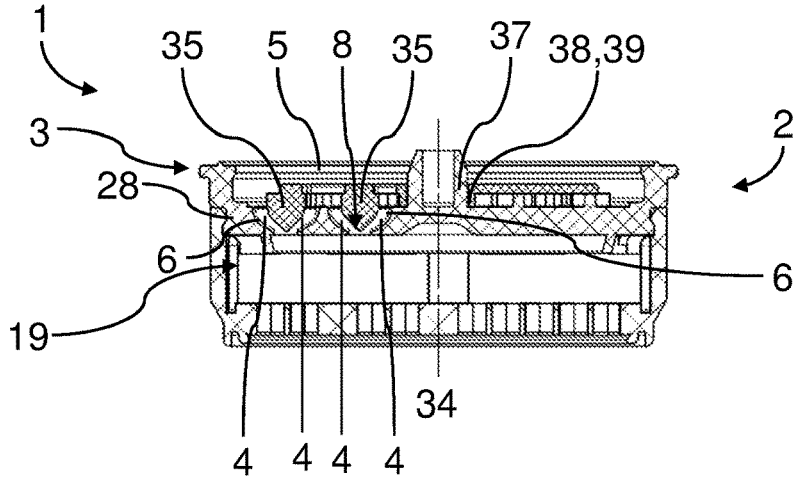
FIG. 14 shows a view in section of the aerator from FIGS. 12 and 13 through the line of section shown in FIG. 13.
Figure 15:
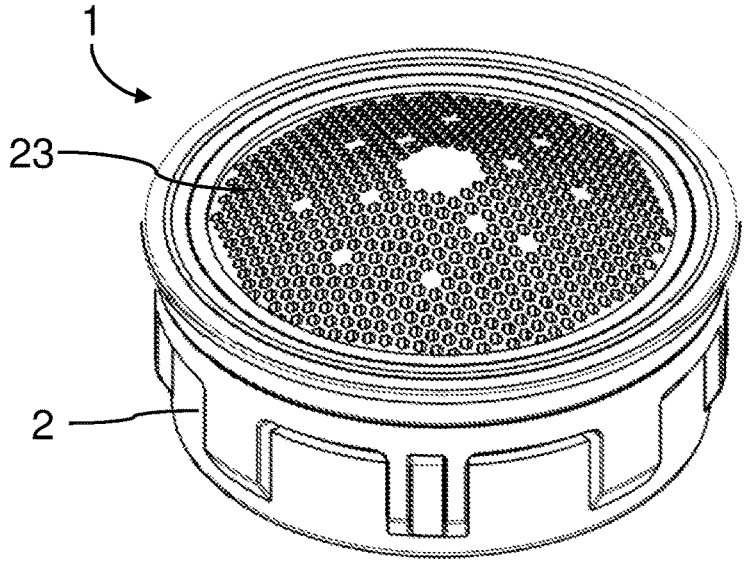
FIG. 15 shows the aerator from FIGS. 12-14 with a screen mounted downstream from the jet-splitting device in the direction of flow.
Figure 16:
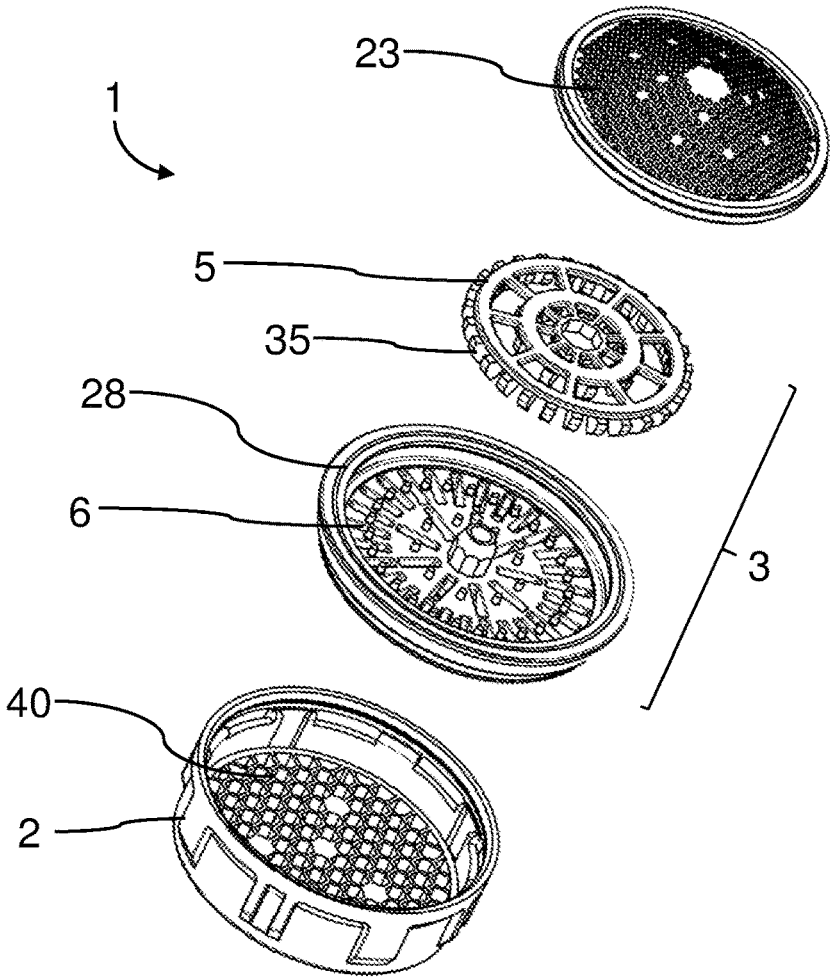
FIG. 16 shows an exploded view of the aerator from FIGS. 12-15.

FIGS. 9 to 11 show a further exemplary embodiment according to the invention. Components and functional units that are functionally or structurally identical or similar to the preceding exemplary embodiment are designated with the same reference numerals and are not described separately. The embodiments in FIGS. 1 to 8 therefore apply to those in FIGS. 9 to 11.

The exemplary embodiment according to FIGS. 9 to 11 differs from the preceding exemplary embodiment at least in that more than two flow channels 4, in this case three flow channels 4, which extend toward the hole 6 in a star shape are associated with the hole 6. Moreover, only a single hole 6 is formed which is covered by a (single) plug-shaped insert part 5 in order to delimit the flow channels 4.

The exemplary embodiment according to FIGS. 9 to 11 can likewise be equipped with a perforated restrictor 20 on the outflow side in the above-described fashion.

It can be generally stated that the insert part 5 has a V-shaped or otherwise convex contour on its outflow side, at least in an axial section. The flow channels 4 which extend toward each other can thus be defined with a single insert part 5. The insert part 5 accordingly has a cross-section that tapers in the direction of flow.

The drawings show that the flow channels 4 extend toward the hole 6 associated with them in a star shape in the exemplary embodiments explained.

In further exemplary embodiments, a plurality of flow channels 4, for example three, four, five, six, or more, which are defined by an insert part 5, are associated with each hole 6 (or the hole 6). The insert part 5 can hereby be formed from one or more parts and/or have an annular or star shape.

The distinctive feature of the alternative embodiment of the aerator 1 according to FIGS. 12-16 can be considered to be that the insert part 5 has at least two insert bodies 35 which are each inserted into a hole 6 of the base body 28 such that each hole 6 is divided in each case into at least two obliquely extending flow channels 4. A number of holes 6 of the base body 28 thus corresponds to a number of insert bodies 35 which are formed by the insert part 5.

The insert bodies 35 are connected to one another via a plurality of retaining webs 36 of the insert part 5. The retaining webs 35 are each oriented in a radial direction and/or arranged in a circle at regular distances from one another. This alternative embodiment of the aerator 1 thus has at least one further nozzle 8. The volume flow per unit time can be increased compared with an embodiment with an insert part that has only one insert body 35 because additional flow channels 4 are thus formed.

In contrast to the production of previously known aerators, there is no constraint regarding the removal of an injection-molding tool from the mold in order to produce the flow channels 4. It is thus possible that an inflow orifice 32 and an outflow orifice 33 of a flow channel 4 are not superimposed along the longitudinal axis 34. In other words, it is also possible to state that the inflow orifice 32 and the outflow orifice 33 are arranged offset with respect to each other in the radial direction. The generation of noise can thus be considerably reduced by the formation of turbulence being prevented.

In order better to prevent turbulence, the flow channels 4 furthermore do not have any steps and instead the structures delimiting the flow channels 4 are formed in a straight line or almost in a straight line or at least with no edges. This is possible because there is no need for a tool to be removed from the mold in the longitudinal direction.

The invention therefore relates in particular to an aerator 1 with a housing 2, a jet-splitting device 3, arranged or formed in the housing 2, for the purpose of splitting an individual stream into a plurality of separate liquid portions, wherein the aerator 1 has at least two flow channels 4 which are oriented obliquely in such a way that the outlet directions 12 defined by the flow channels 4 meet each other, wherein an insert part 5 is inserted into a hole 6, oriented in particular in the longitudinal direction of the housing 2, of a base body 28 of the jet-splitting device 3 such that the hole 6 is divided into the at least two obliquely extending flow channels 4.

LIST OF REFERENCE NUMERALS

1 aerator
2 housing
3 jet-splitting device
4 flow channel
5 insert part
6 hole
7 intersection point
8 nozzle
9 (main) direction of flow
10 stream-aerating device
11 groove
12 outlet angle; outlet direction
13 wall of the base body
14 outer contour of the insert part
15 retaining device
16 upper side of the base body
17 latching projection
18 deflector body
19 chamber
20 perforated restrictor
21 air inlet part
22 mixing part
23 screen
24 flow rate regulator
25 upper housing part
26 lower housing part
27 homogenizing element
28 base body
29 adjusting aid
30 restrictor orifice
31 aerating orifice
32 inflow orifice of the flow channel
33 outflow orifice of the flow channel
34 longitudinal axis of the aerator
35 insert body
36 retaining web
37 assembly cone
38 recess
39 inner wall of the recess
40 outlet side

The invention claimed is:

1. An aerator (1), comprising:

a housing (2), a jet-splitting device (3), arranged or formed in the housing (2), configured to split an individual stream into a plurality of separate liquid portions, the jet-splitting device (3) has at least two flow channels (4) which are oriented obliquely such that streams formed by the flow channels (4) meet each other, and an insert part (5) is inserted into a hole (6) of a base body (28) of the jet-splitting device (3) such that the hole (6) is divided into the at least two obliquely extending flow channels (4), wherein the insert part (5) is fixed on the base body (28) by a retaining device (15) which includes at least one latching projection (17), formed on a surface of an inflow-side upper side (16) of the base body (28), that acts on the insert part (5) with a pretensioning force, wherein the surface of the inflow-side upper side (16) is oriented in a cross-direction to a longitudinal axis of the aerator (1), and wherein the at least one latching projection (17) projects inwardly from the surface of the inflow-side upper side (16) towards a center of the surface of the inflow-side upper side (16).

2. The aerator (1) as claimed in claim 1, wherein the water streams that flow out from the flow channels (4) meet at an intersection point (7), and the intersection point (7) lies inside or outside the base body (28) and/or in the associated hole (6) or in an extension thereof.

3. The aerator (1) as claimed in claim 1, wherein one of the flow channels (4) or both of the flow channels (4) are configured as a nozzle (8) with a cross-sectional surface area which reduces in a main direction of flow (9) or as a diffusor with a cross-sectional surface area which widens in the main direction of flow (9).

4. The aerator (1) as claimed in claim 1, further comprising a stream-aerating device (10) for mixing the liquid portions with air arranged downstream from the jet-splitting device (3) in a main direction of flow (9).

5. The aerator (1) as claimed in claim 1, wherein the insert part (5) is inserted into a groove (11) on an inflow side of the base body (28).

6. The aerator (1) as claimed in claim 1, wherein the insert part (5) is at least one of annular design, plug-shaped, or has a shape that tapers in a main direction of flow (9).

7. The aerator (1) as claimed in claim 1, wherein an outlet angle (12) of the two flow channels (4) is defined by at least one wall (13), forming the hole (6), of the base body (28) and an outer contour (14) of the insert part (5).

8. The aerator (1) as claimed in claim 1, wherein the hole (6) is oriented perpendicular to the insert part (5) in the base body (28), in particular perpendicular to a circumferential direction of the insert part (5).

9. The aerator (1) as claimed in claim 1, wherein liquid flowing through the at least two flow channels (4) subsequently strikes a deflector body (18) of a stream-aerating device (10) arranged downstream from the jet-splitting device (3) in a main direction of flow (9), and wherein a plurality of homogenizing elements (27) are disposed on a deflector surface of the deflector body (18).

10. The aerator (1) as claimed in claim 9, further comprising a perforated restrictor (20) which arranged inside a chamber (19) of the stream-aerating device (10) that divides the chamber (19) into an air inlet part (21) and a mixing part (22), and the mixing part (22) and the air inlet part (21) are connected to each other via a restrictor orifice (30) of the perforated restrictor (20).

11. The aerator (1) as claimed in claim 1, wherein an inflow orifice (32) and an outflow orifice (33) of at least one of the flow channels (4) do not overlap each other along the longitudinal axis of the aerator (1).

12. The aerator (1) as claimed in claim 1, wherein at least one of the flow channels (4) or all the flow channels (4) have a stepless design, without delimiting walls extending in a direction of the longitudinal axis of the aerator (1).

13. The aerator (1) as claimed in claim 1, wherein there are two of the holes (6), and the insert part (5) comprises at least two insert bodies (35) which are inserted in each case into one of the respective holes (6) of the base body (28) such that each said hole (6) is divided into at least two obliquely extending flow channels (4).

14. The aerator (1) as claimed in claim 13, wherein the at least two insert bodies (35) are connected to each other via a plurality of retaining webs (36) that are at least one of oriented in a radial direction or arranged in a circle at regular distances from one another.

15. The aerator (1) as claimed in claim 1, wherein the base body (28) has an assembly cone (37) and the insert part (5) has a recess (38) provided for introduction of the assembly cone (37), an inner wall (39) of said recess being adapted to a shape of the assembly cone (37).

16. The aerator (1) as claimed in claim 2, wherein the intersection point (7) lies inside at least one of a chamber (19), an air inlet part (21), or a mixing part (22).

17. The aerator (1) as claimed in claim 1, wherein the insert part (5) has a V-shaped or convex contour on an outflow side at least in an axial section.

18. The aerator (1) as claimed in claim 9, wherein the deflector body (18) at least one of has a conical shape or tapers in an opposite direction to the main direction of flow (9).

19. A method for producing at least one of a base body (28) or an aerator (1) with a jet-splitting device (3), having the base body (28), the method comprising the steps of:

injection-molding the base body (28) with at least two flow channels (4) which are oriented obliquely, in which two outlet directions (12) of the at least two flow channels (4) meet each other, and inserting an insert part (5) into a hole (6) of the base body (28) such that the hole (6) is divided by the insert part (5) into the at least two obliquely extending flow channels (4), wherein the insert part (5) is fixed on the base body (28) by a retaining device (15) which includes at least one latching projection (17), formed on an inflow-side upper side (16) of the base body (28), that acts on the insert part (5) with a pretensioning force, wherein the surface of the inflow-side upper side (16) is oriented in a cross-direction to a longitudinal axis of the aerator (1), and wherein the at least one latching projection (17) projects inwardly from the surface of the inflow-side upper side (16) towards a center of the surface of the inflow-side upper side (16).

* * * * *